United States Patent [19]

Burgdorf

[11] Patent Number: 4,628,856

[45] Date of Patent: Dec. 16, 1986

[54] COATING APPARATUS WITH TANGENTIAL SLIDE ALLOWING A VERTICAL AND FAST FLOW OF PHOTOGRAPHIC EMULSION

[75] Inventor: Peter K. Burgdorf, Erzhausen, Fed. Rep. of Germany

[73] Assignee: E. I. DuPont de Nemours and Company, Wilmington, Del.

[21] Appl. No.: 752,175

[22] Filed: Jun. 28, 1985

[30] Foreign Application Priority Data

Jul. 6, 1984 [DE] Fed. Rep. of Germany ..... 3424884

[51] Int. Cl.[4] ..... B05C 5/02

[52] U.S. Cl. ..... 118/50; 118/407

[58] Field of Search ..... 118/407, 50, 419

[56] References Cited

U.S. PATENT DOCUMENTS

| | | | |
|---|---|---|---|
| 2,681,294 | 6/1954 | Beguin | 117/34 |
| 2,761,419 | 9/1956 | Mercier et al. | 118/410 |
| 2,933,061 | 4/1960 | Galer | 118/3 |
| 3,867,901 | 2/1975 | Greiller | 118/50 |
| 4,019,906 | 4/1977 | Ridley | 96/68 |
| 4,241,689 | 12/1980 | Kobayashi et al. | 118/50 |
| 4,283,443 | 8/1981 | Choinski | 427/295 |
| 4,287,240 | 9/1981 | O'Connor | 118/407 X |

*Primary Examiner*—John P. McIntosh

[57] ABSTRACT

Apparatus for the application of at least one coating layer on a web support comprising a coating roll over which the web is driven, a coater within a housing, e.g., adjustable for rotation around the axis of the coating roll, having at least one exit slit and a slide connected thereto over which the liquid coating material flows down by gravity to a coating gap terminating at a point adjacent to the coating roll and a pressure chamber placed in close proximity to the coating gap between the tip of the slide surface and coating roll, the improvement wherein the coating gap is located at a point with respect to the coating roll such that the web is moving in a downwardly direction at that point and the coating material is also moving in a downwardly direction, the pressure chamber located above the coating gap and a tangent to the slide surface adjacent to the slide tip extends about parallel to a tangent to the coating roll at the coating gap.

18 Claims, 5 Drawing Figures

COATING APPARATUS WITH TANGENTIAL SLIDE ALLOWING A VERTICAL AND FAST FLOW OF PHOTOGRAPHIC EMULSION

FIELD OF THE INVENTION

This invention relates to web coating apparatus and more particularly to web coating apparatus in which a liquid coating material flows by gravity onto a support to be coated.

BACKGROUND INFORMATION

Extremely high quality coatings may be obtained through a conventional multi-slide coating apparatus, as disclosed in Mercier et al. U.S. Pat. No. 2,761,419 which teaches coating a moving web by metering individual layers of a coating fluid from a supply, through a trough disposed inside a hopper and then through a narrow distribution slot. The fluid is distributed by the slot as a layer uniformly across a downwardly inclined slide surface. The layer of coating fluid flows by gravity down the slide surface. Where more than one layer is coated, the flowing layer meets with the adjacent underlayers of coating fluid which have been similarly metered and distributed through narrow slots. The combined coating fluid layers then flow down the slide surface bridging the gap between the tip of the slide surface and the web, forming a coating bead. The web is carried by a back up roll and is moved across the bead. The fluid layers impinge upon the moving web which picks up the multilayer coating fluids from the slide surface. The coating roll rotates in a direction such that the support moves upwardly in the area of the coating bead. The impingement point is situated approximately in a plane located on the horizontal diameter with reference to the coating roll. Typically, the slide surface makes an angle of between 10 and 45 degrees to the horizontal. In order to stabilize the coating bead, a low pressure chamber may be placed adjacent to the coating roll below the sliding surface, (as shown in Beguin U.S. Pat. No. 2,681,294).

The aforementioned technique has resulted in coating high-quality thin layers on web supports, and is practiced extensively by the photographic industry to coat radiation sensitive emulsions on a web, e.g., a polyester film support. However, the coating rate, for instance, the velocity of the web support when the aforementioned technology is employed is restricted within a narrow range for a given coating fluid. Outside of this range defects such as longitudinal streaks, fogging and pin-point holes may occur in the coating.

In order to increase coating rates, it has been proposed to provide a buffer zone in which the inclined surface changes direction and may even be inclined in an upward direction. A pool of coating material may also be created at the bottom of the slide so that the coating material spans the coating gap beyond the slide surface after its downward flow rate has been reduced to a minimum as shown in Choinski U.S. Pat. No. 4,283,443. In this case the coating material is accelerated in a downwardly direction by the coating device and then redirected to approach the coated web in a tangential direction. A substantial increase in the permissible coating rate range is not, however, obtained since the coating solution must be accelerated from the low velocity of the fluids in the pool to the web velocity.

Another coating device of the type shown in Galer U.S. Pat. No. 2,933,061 is known in which the coating material is applied onto a downwardly moving supporting web by means of a flexible trailing blade. Kobayashi et al. U.S. Pat. No. 4,241,689 shows a fixed coating head which may be used in place of the flexible blade so that a wedge shaped gap between the head and the support is filled with coating material. A pressure controlling chamber is provided below this gap to stabilize the coating material within the gap. Only one coating layer at a time can be applied by this method. Difficulties are also present when it is attempted to apply very thin layers using the method of coating over a slide surface.

A curtain coating device such as shown in Ridley U.S. Pat. No. 4,019,906, in which the coating material is directed over a slide whose final section is vertical is also known. In this arrangement, a supporting web to be coated runs horizontally below the slide. The distance between the slide tip and the support is traversed by the coating material in free fall. This device is only suitable for high coating speeds. The falling coating material undergoes a 90 degree turn. The coating material forms a curtain as it bridges the gap between the tip of the slide coater and the moving web which is more difficult to stabilize then a bead in a bead coating apparatus. Lateral constriction is also present when this method is employed.

It is desirable to provide a device which will allow a greater operating range of coating speeds and more particularly higher coating speeds then previously possible for a given coating material.

SUMMARY OF THE INVENTION

In accordance with this invention there is provided an apparatus for the application of at least one coating layer on a web support comprising a web supporting coating roll over which the web is driven, a coater within a housing having at least one exit slit for liquid coating material and a slide connected to at least one exit slit over which the liquid coating material flows down by gravity to a coating gap terminating at a point adjacent to the roll, and a pressure chamber placed in close proximity to the coating gap between the tip of the slide surface and the coating roll, the improvement wherein the coating gap is located at a point with respect to the coating roll such that the supported web is moving in a downwardly direction at that point and the material to be coated is also moving in a direction that includes a downwardly directed component, the pressure chamber being located above the coating gap, and a tangent to the slide surface adjacent to the tip of the slide extends approximately parallel to a tangent to the coating roll at the gap.

BRIEF DESCRIPTION OF THE DRAWINGS

The invention can best be understood with reference to the attached figures which form an integral part thereof and in which.

DETAILED DESCRIPTION OF THE INVENTION

Figure 1:
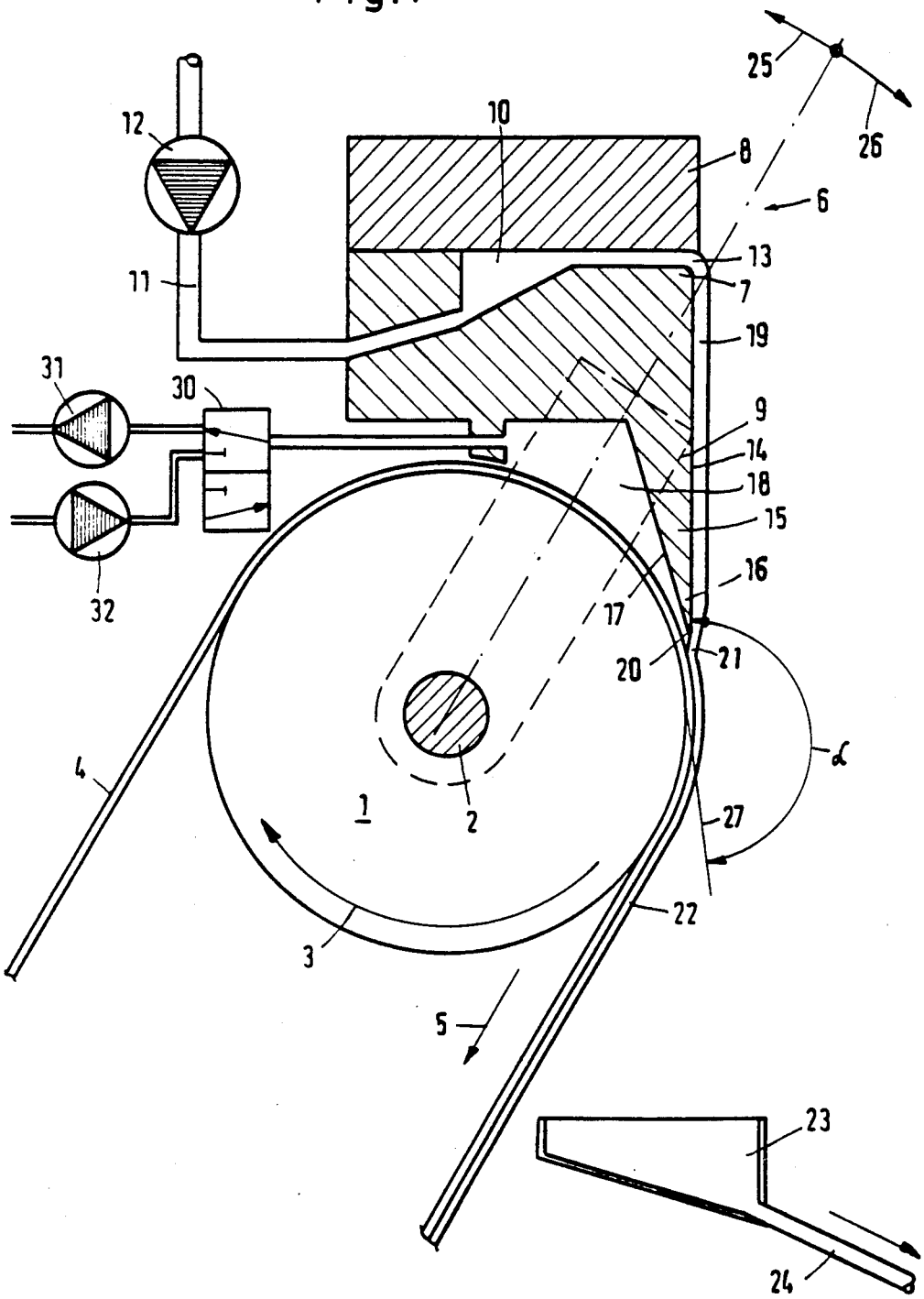
FIG. 1 is a schematic cross section of a device in accordance with this invention.

Referring now to FIG. 1 there is illustrated a coating roll 1 having a driven shaft 2 which drives the roll in direction of arrow 3. This coating roll serves to support a web 4 which is driven by the roll in the direction of arrow 5.

A coating apparatus generally designated by numeral 6 comprises a housing 7 which is provided with a lid 8. The housing is supported on either side by arms 9 which allow it to be adjusted rotatably around the axis of the coating roll 1. The supporting arms 9 permit placing the coating device in any position along the perimeter of coating roll 1. A metering pump 12 is connected through a tube 11 to a distribution header 10 and therefrom through an exit slot 13 to essentially a vertical slide 14. Slide 14 faces in the same direction as the outer surface of roll 1. Thus, slide 14 faces away from the surface of roll 1. A coating lip 15 projects downwardly from housing 7. The coating lip has a flat outer surface in the lower most portion of the slide 16. The portion of the lip facing the coating roll, inner face 17, is also flat and is angled towards the lower most portion of the slide 16. Inner face 17 forms one wall of a pressure chamber 18 connected via a switching device 30 to a suction pump 31 and a pressure pump 32. A drip pan receptacle 23 including a drain line 24 is situated below the roll under coating gap 20. Drips of coating material are caught and may be recirculated for further use. The pressure chamber 18 can be supplied with high pressure by activating the switching device 30 so that air is blown through the coating gap 20. This prevents the coating layer 19 from being deposited on the web 4, stopping the coating and also preventing soiling of the support. Coating material is then caught in receptacle 23. This allows an interruption of the coating process without depositing any material on the web. It is preferable to move the coating roll 1 away from the coater 6 at the same time as the switching device 30 is activated if the coating process is to be interrupted.

Coating material emerging from the exit slot 13 runs down the slide 14 as coating layer 19 and crosses the coating gap 20 between the coating lip 15 and the web 4 for deposit on the web. A very small, almost insignificant, size bead 21 is formed at the transition point because the coating layer 19 is feed onto the web 4 almost without changing direction. The bead 21 is held and stabilized by low pressure applied in the pressure chamber 18. The web 4 runs past the coating gap 20 at a rate that it is a multiple, preferable 2.5 to 20 times, the rate of flow of the coating layer 19 at the bottom of the slide 14, so that the coating layer is stretched in the area of bead 21. As a result, the coating 22 on web 4 is correspondingly less thick than the coating layer 19.

In FIG. 1 the entire slide 14 runs at an angle of 90 degrees to the horizontal. The coater 6 can be rotated in the direction of arrow 25 by 70 degrees and in the direction of arrow 26 by 30 degrees around the axis of the coating roll 1. As a result, the slide 14 may make an angle to the horizontal varying between 20° to 120°. The plane of the surface of slide 14 or its extension forms an angle (alpha) with a plane tangent to the coating roll 1 at the coating point which is of the order of 175°. Thus, the coating layer 19 passes from the surface of slide 14 onto the web 4 almost without change of direction. This angle remains the same regardless of the positioning of the tip of slide 14 in the direction described above.

Figure 2:
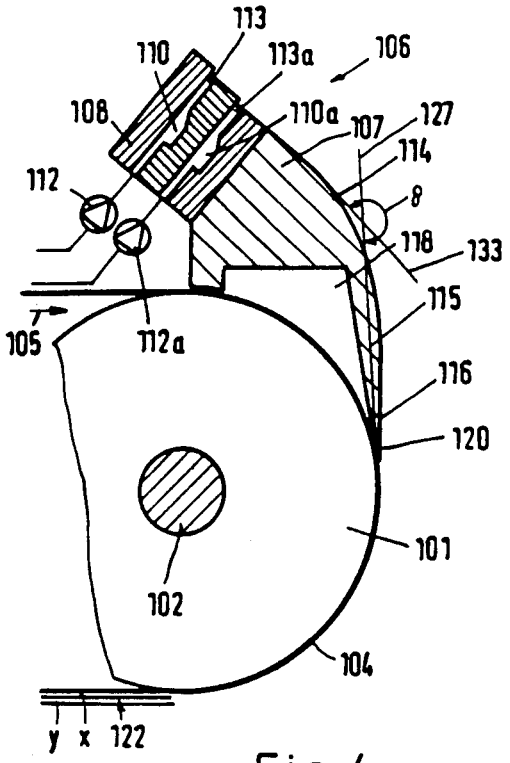
FIG. 2 shows a partial cross section of a modified embodiment of this invention, FIG. 3 show partial cross section enlargement of the placement of the tip of the coating slide in relation to the back up roll.

With reference now to an alternate embodiment shown in FIG. 2 in which corresponding elements are indicated with numbers similar to those given in FIG. 1 preceded by 100, an apparatus capable of coating 2 layers at the same time as shown. The apparatus is provided with an additional coating material supplying slot. Thus, two exit slots 113 and **113*a* are supplied one above the other, each connected with a distribution header 110 or 110*a*, respectively. Two metering pumps, 112 and 112*a*, are employed. As a result, a coating layer 122 is formed which comprises two sublayers x and y as illustrated schematically on the web at the lower most part of FIG. 2. Moreover, the support 104 after leaving the coating roll 101** runs approximately horizontally in the total conditioning zone. Matting particles contained in layer y thus do not penetrate layer x, but go to the free surface of the coating. If layer x contains particles that produce an optimal thickness, pinholes in the coating are avoided.

It is noted that this arrangement also differs in that the upper part of slide 114 is convex. For instance, it begins with a lower angle of inclination with respect to the horizontal yet the final section 116 terminates vertically. The angle (gamma) between the tangent 127 to the coating roll 101 and a tangent 133 at any point along the slide 114 is greater than 160°. In the upper portions of the slide, this tangent is greater than 180°

Figure 3:
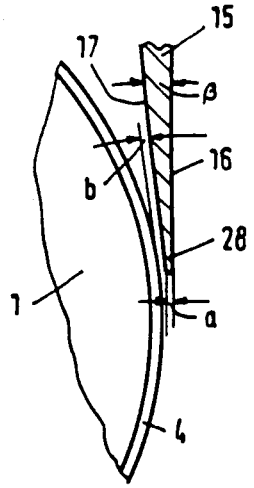

FIG. 3 shows a portion of FIG. 1 enlarged. The coating lip details are shown. The coating lip 15 is shown as wedge shaped the wedge angle (beta) is smaller than 15°, and is preferably 8° to 10°. As a result, a very narrow final section 28 of the coating lip 15 is formed. Its width "a" is less than 0.5 mm and preferably is 0.2 mm. The distance "b" between the inner face 17 and the surface of web 4 is also very small. The distance b is likewise less than 0.5 mm and preferably is 0.25 mm.

Figure 4:
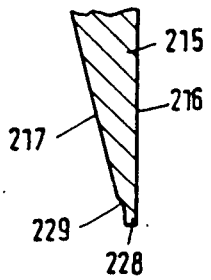
FIGS. 4 and 5 show modified versions of the lip terminating the coating slide.
Figure 5:
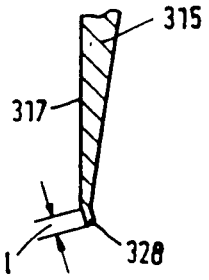

In FIG. 4 the inner face 217 of the coating lip 215 is shown provided with a hollow 229 running concentrically to the perimeter of the coating roll (not shown) terminating in a thin yet strong tip 228. This improves the transfer of the coating solution by making it as close to a tangential transfer as possible. In the embodiment of FIG. 5 the coating lip 315 is provided with a bent final section 328 so that it can be fitted very close to the coating roll (not shown); nevertheless, the inner face 317 remains sufficiently distant from the support to allow air to be removed through the pressure chamber 18 (not shown). The length (l) of the final section closely adjacent to the support should not be too great. It is proven useful in practice for such length to be less than or equal to 1 mm. In this manner the effect of the low pressure in the coating gap is still sufficiently high. The selected length l must be correspondingly smaller, however, as the gap 20 decreases and/or the coating rate increases.

In operation the coating material runs from the bottom of the slide onto the web almost without turning. As a result, the coating material can be conveyed over this slide surface at a relatively high velocity as would result in the extreme case where the slide is a vertical slide. When the coating material is delivered from the coating lip onto the moving web, this maximum delivery velocity is close enough to the web velocity so that only a minimum of further acceleration of the coating material is needed to match the two speeds. No pronounced coating bead with a corresponding mass is formed in the coating gap as is the case when a turn is present as described in the prior art teachings. The bead is almost insignificant and has only a very slight tendency to enter into oscillations which result into coating defects. The low pressure applied behind it is usually sufficient to prevent it from entering into such oscillations. Thus, defects attributed to centrifugal forces occurring during a change of direction of the coating fluids, such as pin-point holes in the coating and transverse step defects which are formed by outside stimuli and which appear to be dependent on the size of the coating bead and its stability are reduced. The maximum stretch ratio between the layer thickness and the coating material at delivery and thickness of the layer of the coating material on the web support is higher because the stretching in the bead is no longer accompanied with a change of direction. This leads to an increase in the coating speed. Since every coating material can only be stretched within a limited range, it is a preliminary requirement for high coating rates that the coating material be brought to the highest possible delivery rate even before the stretching process. This is precisely what is possible here by using a very steep slide so that extraordinarily high coating rates can be attained taking the stretching ratio into consideration without incurring transverse step defects or streaks. In particular, the velocity range that can be covered lies between the previous upper limit of bead coating devices and the lower limit of curtain coating devices.

On the other hand, if high coating rates are not desired, coating materials of higher viscosity may be coated. This makes it possible to lower the surface temperatures in the drying phase and to eliminate defects such as tearing of the surface, wrinkling or drying haze which occur during drying resulting in improved coating appearance. Positioning the pressure chamber above the coating gap keeps the pressure chamber free from coating material and avoids its regular cleaning requiring interruptions of the coating process.

In a preferred embodiment, the angle between the extension of the slide surface at or near the impingement point and a tangent to the coating roll at the same point is between 170° to 180° and preferably is larger than 175°. The sliding surface can be flat or convex to gradually create a desired flow rate. It is desirable that the angle between the tangent at any point of the slide and the tangent to the coating roll in the area where the coating material impinges thereon should also be larger than 160°.

It is particularly desirable for the inclination angle of the slide with respect to the horizontal to be between 20° and 120° and preferably between 75° and 105°. The most preferred angle is about 90°. This allows relatively high flows to be achieved and lead to correspondingly high coating rates.

The coater can be rotated around the axis of the coating roll and can be adjusted so that the slide surface makes an angle at 20° to 120° with a horizontal. In this manner, the optimum operating position may be set for each individual case.

Preferably the essentially flat inner face of the coating lip forms an angle of less than 15°, preferably about 8° to 10°, with the essentially flat outer face. Such a coating lip has a very narrow lower final section, sufficient stability, and is adjacent to a pressure chamber that broadens sufficiently as it leaves the vicinity of the coating gap to ensure that the air is exhausted. Manufacture of the coating lip is also facilitated by using the flat surfaces. The flat inner face of the coating lip can hereby be hollowed out at the bottom to match the periphery of the coating roll. This makes it possible for it to be more adjustable to the coating roll. The final section of the coating lip can also be slightly bent inwards or outwards at the bottom in order to make it fit the coating roll.

In a preferred embodiment the coating roll has a radius smaller than the length of the slide, and in particular the coating roll should have a diameter of maximum 17 cm, preferably about 8 to 12 cm. With such a diameter, the curve of the periphery of the roll considerably facilitates the installation of the coating lip so as to apply the coating layer at a tangent.

In a still more preferred embodiment, the coating gap is placed in a plane defined by the horizontal diameter of the coating roll. A receptacle placed below the coating gap will then receive any material that may drip during the coating process without soiling the running web or other parts of the coating device.

The availability of a switching device which allows to switch from low pressure to high pressure in the vacuum box permits the coating layer to be removed from the web in a positive manner without producing any undesired soiling. Similarly, the coating layer may be kept away from the web until a certain point in time at which time switching the device to low pressure will bring the coating layer against the support.

I claim:

1. An apparatus for the application of at least one layer of liquid coating material on a web support comprising a web supporting coating roll over which the web is driven, a coater within a housing having at least one exit slit for liquid coating material and a slide connected to at least one exit slit over which the liquid coating material flows down by gravity to a coating gap terminating at a point adjacent to the roll, and a pressure chamber placed in close proximity to the coating gap between the tip of the slide surface and the coating roll, the improvement wherein the coating gap is located at a point with respect to the coating roll such that the supported web is moving in a downwardly direction at that point and the material to be coated is also moving in a direction that includes a downwardly directed component, the pressure chamber being located above the coating gap, and a plane of the slide surface adjacent to the tip of the slide extends approximately parallel to a tangent to the coating roll at the gap.

2. Apparatus according to claim 1 wherein the angle $\alpha$ between the lowermost portion of the slide and the tangent to the coating roll in the area where the coating material meets the web on the coating roll is between 170° to 180°.

3. Apparatus according to claim 1 wherein the angle between the tangent at any point of the slide and the tangent to the coating roll in the area where the coating material meets it is larger than 160°.

4. Apparatus according to claim 1 wherein the slide is convex.

5. Apparatus according to claim 1 wherein the angle of inclination of the slide to the horizontal is between 20° and 120°.

6. Apparatus according to claim 1 wherein the lowermost portion of the slide is formed by the external face of a coating lip projecting from the coater housing, the coating lip terminating at the bottom in a very narrow final section.

7. Apparatus according to claim 6 wherein the width of the lower final section of the coating lip is less than 0.5 mm.

8. Apparatus according to claim 6 wherein the coating lip has an inner face and the distance between said inner face and the web is less than 0.5 mm.

9. Apparatus according to claim 8 wherein the inner surface of the coating lip beginning from the lower end runs concentrically to the coating roll over a maximum peripheral length of 1 mm and then the distance between the said inner surface and the coating roll increases.

10. Apparatus according to claim 8 wherein the inner face of the coating lip is essentially flat and forms an angle of less than 15° with the external face of the coating lip which is also essentially flat.

11. Apparatus according to claim 10 wherein the flat inner face of the coating lip has a hollow which matches the periphery of the coating roll.

12. Apparatus according to claim 6 wherein the final section of the coating lip is bent inwards or outwards at the bottom.

13. Apparatus according to claim 1 wherein the coating roll has a radius smaller than the length of the coating slide.

14. Apparatus according to claim 13 wherein the coating roll has a maximum diameter of 17 cm.

15. Apparatus according to claim 1 wherein the coater is adjustably supported for rotation around the axis of the coating roll, the adjustment of the slide angles being 20° to 120° to the horizontal.

16. Apparatus according to claim 1 wherein the coating gap is located near the horizontal diameter plane of the coating roll, a receptacle is present below the coating gap, and the coated web can be moved away between the coating roll and receptacle.

17. Apparatus according to claim 1 wherein a switching device is connected to the pressure chamber whereb said chamber can be supplied with high pressure.

18. An apparatus for the application of at least one layer of liquid coating material on a support in the form of a moving web, with a rotating coating roll conducting the support, with a coater having at least one exit slit for liquid coating material and a slide connected to it over which the liquid coating material runs down to a coating slit by gravity, and with a low-pressure chamber connected to the coating slit between the coater and the support to be coated, the improvement wherein the coating slit is situated at a peripheral point of the coating roll having a downwards movement component, that the coater and the low-pressure chamber are placed above the coating slit, that the exit slit and slide are situated on the external side of the coater away from the coating roll, and that the extension of the final section of the slide runs approximately at a tangent to the coating roll at the gap.

* * * * *